United States Patent [19]

Ellett

[11] 4,152,621

[45] May 1, 1979

[54] ELECTRON DISCHARGE DEVICE

[75] Inventor: Alexander Ellett, River Forest, Ill.

[73] Assignee: Zenith Radio Corporation, Glenview, Ill.

[21] Appl. No.: 209,184

[22] Filed: Feb. 2, 1951

[51] Int. Cl.[2] ..... H01J 1/94; H01J 19/48; H01K 1/18

[52] U.S. Cl. ..... 313/278

[58] Field of Search ..... 313/274, 278, 317, 269, 313/284

[56] References Cited

U.S. PATENT DOCUMENTS

| | | | |
|---|---|---|---|
| 1,028,118 | 6/1912 | Knowles | 313/278 |
| 2,439,401 | 4/1948 | Smith | 313/278 |
| 2,504,504 | 4/1950 | Despois | 313/317 |

*Primary Examiner*—Theodore Blum

*Attorney, Agent, or Firm*—John J. Pederson

EXEMPLARY CLAIM

1. An electron-discharge device comprising: an evacuated envelope; a cold electrode supported within said envelope; a thermionic filamentary cathode; and means including at least one spring member affixed to said cathode and supported from said envelope for normally supporting said cathode in tension in a position within said envelope spaced from said cold electrode and adapted to relax said tension in response to rapid acceleration of said envelope in a predetermined direction perpendicular to said filamentary cathode, the space between said normal position of said cathode and the inner wall of said envelope being substantially unobstructed in a direction opposite to said predetermined direction whereby said cathode is supported by said wall throughout substantially its entire length when subjected to said acceleration.

6 Claims, 2 Drawing Figures

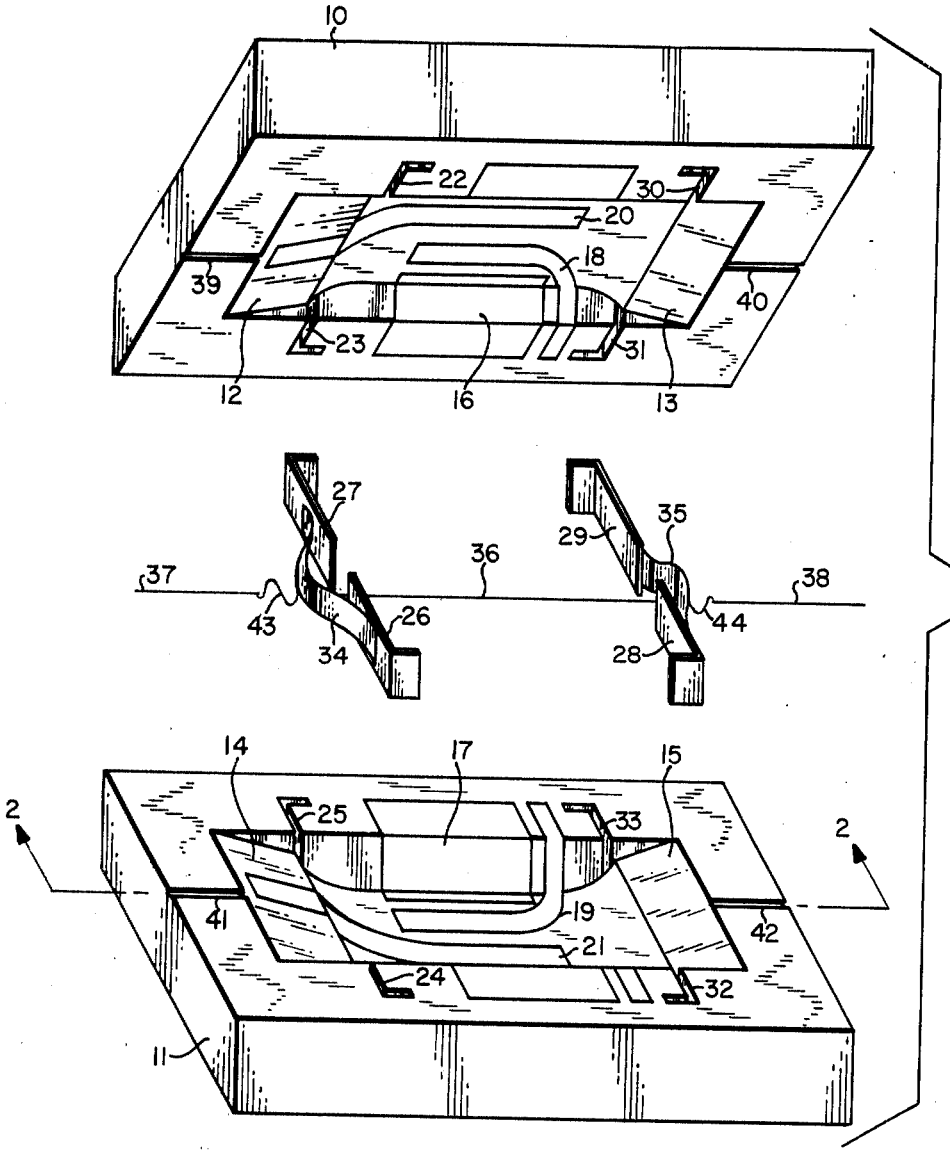
Fig. 1
Fig. 2
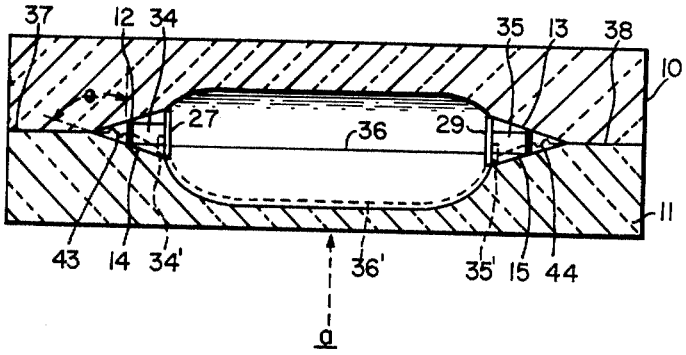
INVENTOR.
ALEXANDER ELLETT
BY Francis W. Crosby
HIS ATTORNEY

ELECTRON DISCHARGE DEVICE

This invention relates to electron-discharge devices and more particularly to such devices of the type particularly adapted for use in radio-controlled high-speed projectiles such as proximity fuses and the like.

Until very recently, the maximum acceleration to which radio equipment has been subjected has been about twenty thousand times the force of gravity. While it is well known that such accelerations impart severe stresses to electron-discharge devices and other component structures, and particularly to filamentary cathodes within the control tubes, it has been possible to avoid excessive breakage by employing ruggedized structures of an otherwise more or less conventional type. However, modern developments have resulted in the attainment of accelerations of from forty thousand to fifty thousand times the force of gravity, and even higher accelerations may be achieved in the future. It has been found that the ruggedized tubes previously suitable for use in radio-controlled projectiles may no longer be employed at such higher accelerations since the stresses are so great as to result in filament breakage rendering the radio apparatus inoperative. It is therefore apparent that if it is desired to obtain the advantages of the now-attainable higher initial acceleration, resulting in increased range for the projectile, means must be provided for insuring that the filaments and other electrodes of the tubes employed are protected against breakage from the extremely high stresses caused by the rapid acceleration.

It is therefore an important object of the present invention to provide a new and improved electron-discharge device which is particularly suitable for use in radio-controlled projectiles such as proximity fuses or the like.

Another object of the invention is to provide a new and improved electron-discharge device of the type employing a filamentary cathode which is capable of withstanding accelerations of the order of forty thousand to fifty thousand times the force of gravity without impairment of subsequent tube operation.

The objects of the invention are achieved by providing an electron-discharge device comprising an evacuated envelope, preferably constructed of a pair of cupped insulating members juxtaposed with their concavities in mutually contiguous relation to define a continuous cavity. A filamentary cathode is normally supported in tension within the envelope by means including at least one spring member affixed to the cathode and supported from the envelope. The spring member is adapted to relax the tension normally applied to the filamentary cathode in response to rapid acceleration of the envelope in a predetermined direction perpendicular to the filamentary cathode. In this manner the tension on the cathode is relaxed during the period of extreme initial acceleration so that the cathode is urged into engagement with a wall of the envelope however, when the tube attains a constant velocity (zero acceleration), the spring member operates to restore the cathode to its initial or normal position to ready the tube for subsequent operation. It is also preferred that the one or more cold electrodes of the tube be constructed in the form of one or more conductive coatings on the inner wall of the tube envelope.

The features of the present invention which are believed to be novel are set forth with particularity in the appended claims. The invention, together with further objects and advantages thereof, may best be understood, however, by reference to the following description taken in connection with the accompanying drawings, in the several figures of which like reference numerals indicate like elements, and in which:

FIG. 1 is an exploded perspective view of an electron-discharge device constructed in accordance with the invention; and FIG. 2 is a cross-sectional view taken along the line 2—2 in FIG. 1 after assembly of the device.

As shown in FIG. 1, an electron-discharge device constructed in accordance with the invention may comprise a pair of hollowed-out blocks 10 and 11 constructed of insulating material, preferably glass, steatite ceramic or the like, which when juxtaposed with their concavities in mutually contiguous relation define a continuous inner cavity in which are provided the operating elements of the tube. Inclined ledges 12, 13 and 14, 15 are formed at the opposite ends of blocks 10 and 11 respectively for a purpose to be hereinafter described. A plurality of cold electrodes are provided in the form of conductive coatings on the internal wall of the envelope, coatings 16 and 17 for example constituting an anode, 18 and 19 a control electrode, and 20 and 21 a focusing electrode. The conductive coatings constituting the control electrode 18, 19 and the anode 16, 17 may conveniently be extended over the interfaces of the two blocks 10 and 11 in such a manner that corresponding electrodes in the two envelope-sections are automatically interconnected by juxtaposition of the two blocks. External connections may be made to the several electrodes in any suitable manner well known to the art; for example, external leads may be fused through the glass or ceramic envelope until contact is achieved with the abutting portions of the electrodes at the interface.

Blocks 10 and 11 are slotted at 22, 23 and 24, 25 respectively to receive a pair of spaced brackets 26 and 27. A similar pair of brackets 28 and 29 are supported by slots 30, 31 and 32, 33 in envelope-sections 10 and 11. A pair of leaf springs 34 and 35 are biased against brackets 26, 27 and 28, 29 and are positioned within the envelope between inclined ledges 12, 14 and 13, 15 respectively. A filamentary cathode 36, preferably constructed of tungsten, is affixed to leaf springs 34 and 35 and is provided with external leads 37 and 38 received by channel portions 39, 40, 41, and 42 in the interfaces of envelope-sections 10 and 11. Of course, suitable precautions must be taken to insure an hermetic seal of leads 37 and 38 to the composite envelope. Leads 37 and 38 are also provided with slack portions 43 and 44 respectively for a purpose which will become apparent. Spring member 34 engages extensions of conductive coatings 20 and 21 which overlie inclined ledges 12 and 14, so that the focusing electrode is maintained at substantially cathode potential during operation of the tube after it has attained a substantially constant velocity.

After assembly, the tube is evacuated in any suitable manner known in the art. For this purpose a suitable tubulation (not shown) in the envelope may be provided, and the tubulation may be countersunk or flanged to prevent breakage and admission of air which might otherwise be occasioned by the concussion accompanying propulsion of the tube. Also, suitable means (not shown) may be provided for gettering the tube during the evacuating operation.

FIG. 2 is a cross-sectional view of the device shown in FIG. 1 after assembly and taken along the line 2—2 in FIG. 1. Cold electrodes 16, 17, 18, 19, 20, and 21 have been omitted from the showing of FIG. 2 in order to avoid confusion of the drawing. As is apparent from a consideration of FIG. 2, filamentary cathode 36 is normally supported in tension in a position substantially centrally of the cavity owing to the natural restoring force of leaf springs 34 and 35. In this normal condition, whenever the tube is at rest or moving at a substantially constant velocity, leaf springs 34 and 35 about inclined ledge portions 14 and 15 of the cavity at an acute angle $\theta$.

In accordance with a feature of the invention, the angle $\theta$ between spring members 34 and 35 and inclined ledges 14 and 15 respectively is made sufficiently large that its tangent exceeds the coefficient of static friction between the spring members and the envelope. Thus, when the device is subjected to rapid acceleration in a predetermined direction perpendicular to filamentary cathode 36, indicated by the dotted arrow a, spring members 34 and 35 are stressed in a direction opposite their respective storing forces until cathode 36 assumes the position 36' shown in dotted lines in which it abuts the inner wall of the envelope. Brackets 26, 27, 28, and 28 serve as effective limiting stops to prevent springs 34 and 35 from being overstressed, the limiting positions of the spring members being indicated in dotted lines at 34' and 35'. In this manner, spring members 34 and 35 absorb most of the stress resulting from rapid acceleration of the tube in the direction indicated by arrow a, and so long as the tube is accelerated only in that direction, filament 36 is protected against breakage. After the initial period of rapid acceleration, when the tube attains a constant velocity, the restoring action of spring members 34 and 35 restores cathode 36 to its normal tensed position to condition the tube for subsequent operation. Slack portions 43 and 44 of external leads 37 and 38 permit migration of spring members 34 and 35 in the described manner while preventing fracture of the leads. During the period of rapid acceleration, the cathode may contact one of the cold electrodes, but this is not detrimental since the tube is not energized until after it has attained constant velocity and the cathode has been restored to its normal tensed position.

As a practical matter, the coefficient of static friction between those metals suitable for use within the evacuated envelope and suitable envelope materials is of the order of from 0.75 to 1.0. For example, the coefficient of static friction between nickel and glass has been listed in mechanical engineering handbooks as about 0.78. Thus, the angle $\theta$ at which the spring members abut the cavity is preferably greater than arc tan 0.75, or about 38 degrees. An angle greater than 45 degrees is preferred in practice to insure that the tension on cathode 36 is relaxed in response to acceleration of the tube in the direction indicated by arrow a.

While spring members 34 and 35 have been shown and described as leaf springs in the illustrated embodiment, it is also possible to construct these members as cantilever springs, wire springs or other alternative types of spring suspension. It is only essential in accordance with the invention that the spring members be constructed and arranged in such a manner that the filamentary cathode is normally supported in tension in a position within the envelope spaced from the cold electrode and that that tension is relaxed in response to rapid acceleration of the device in a predetermined direction perpendicular to the filamentary cathode. Moreover, a single spring member may be employed, the other end of the filamentary cathode being solidly supported between the two envelope sections.

While a particular embodiment of the invention has been shown and described, it is apparent that various changes and modifications may be made, and it is therefore contemplated in the appended claims to cover all such changes and modifications as fall within the true spirit and scope of the invention.

I claim:

1. An electron-discharge device comprising: an evacuated envelope; a cold electrode supported within said envelope; a thermionic filamentary cathode; and means including at least one spring member affixed to said cathode and supported from said envelope for normally supporting said cathode in tension in a position within said envelope spaced from said cold electrode and adapted to relax said tension in response to rapid acceleration of said envelope in a predetermined direction perpendicular to said filamentary cathode, the space between said normal position of said cathode and the inner wall of said envelope being substantially unobstructed in a direction opposite to said predetermined direction whereby said cathode is supported by said wall throughout substantially its entire length when subjected to said acceleration.

2. An electron-discharge device comprising: an envelope comprising a pair of cupped members constructed of insulating material and juxtaposed with their concavities in mutually contiguous relation to define a continuous cavity; a cold electrode supported on a wall of said cavity; a thermionic filamentary cathode; and means including at least one spring member affixed to said cathode and supported from said envelope for normally supporting said cathode in tension substantially centrally of said cavity and adapted to relax said tension in response to rapid acceleration of said envelope in a predetermined direction perpendicular to said filamentary cathode, the space between said normal position of said cathode and the inner wall of said envelope being substantially unobstructed in a direction opposite to said predetermined direction whereby said cathode is supported by said wall throughout substantially its entire length when subjected to said acceleration.

3. An electron-discharge device comprising: an evacuated envelope; a cold electrode supported within said envelope; a thermionic filamentary cathode; and means including a pair of spring members affixed to opposite ends of said cathode and supported from said envelope for normally supporting said cathode in tension in a position within said cavity spaced from said cold electrode and for relaxing said tension in response to rapid acceleration of said envelope in a predetermined direction perpendicular to said filamentary cathode, the space between said normal position of said cathode and the inner wall of said envelope being substantially unobstructed in a direction opposite to said predetermined direction whereby said cathode is supported by said wall throughout substantially its entire length when subjected to said acceleration.

4. An electron-discharge device comprising: an envelope comprising a pair of cupped members constructed of insulating material and juxtaposed with their concavities in mutually contiguous relation to define a continuous cavity; a cold electrode supported within said cavity; a thermionic filamentary cathode; and means including at least one spring member affixed to said cathode and supported from said envelope for normally supporting said cathode in tension in a position within said cavity spaced from said cold electrode and for relaxing said tension in response to rapid acceleration of said envelope in a predetermined direction perpendicular to said filamentary cathode, the space between said normal position of said cathode and the inner wall of said envelope being substantially unobstructed in a direction opposite to said predetermined direction whereby said cathode is supported by said wall throughout substantially its entire length when subjected to said acceleration.

5. An electron-discharge device comprising: an envelope comprising a pair of hollowed-out ceramic members juxtaposed with their concavities in mutual by contiguous relation to define a continuous cavity; a cold electrode supported on a wall of said cavity; a filamentary cathode; a pair of spaced brackets supported from said envelope; and a spring member affixed to said cathode and biased against said brackets for normally supporting said cathode in tension in a position within said cavity spaced from said cold electrode and for relaxing said tension in response to rapid acceleration of said envelope in a predetermined direction perpendicular to said filamentary cathode.

6. An electron-discharge device comprising: an envelope comprising a pair of hollowed-out ceramic members juxtaposed with their concavities in mutually contiguous relation to define a continuous cavity; a cold electrode supported on a wall of said cavity; a filamentary cathode; a pair of spaced brackets supported from said envelope; and a spring member affixed to said cathode and biased against said brackets and abutting said cavity at an acute angle the tangent of which exceeds the coefficient of static friction between said spring and said envelope for normally supporting said cathode in tension in a position within said cavity spaced from said cold electrode and for relaxing said tension in response to rapid acceleration of said device in a predetermined direction perpendicular to said filamentary cathode.

* * * * *